US010566722B2

(12) United States Patent
Lee et al.

(10) Patent No.: US 10,566,722 B2
(45) Date of Patent: Feb. 18, 2020

(54) FLOAT-TYPE CONNECTING MODULE AND FLOAT-TYPE DOCKING DEVICE HAVING THE MODULE

(71) Applicant: Getac Technology Corporation, Hsinchu County (TW)

(72) Inventors: Kun-Cheng Lee, Taipei (TW); Juei-Chi Chang, Taipei (TW)

(73) Assignee: GETAC TECHNOLOGY CORPORATION, Hsinchu County (TW)

( * ) Notice: Subject to any disclaimer, the term of this patent is extended or adjusted under 35 U.S.C. 154(b) by 0 days.

(21) Appl. No.: 16/038,576

(22) Filed: Jul. 18, 2018

(65) Prior Publication Data

US 2020/0028292 A1 Jan. 23, 2020

(51) Int. Cl.

| | |
|---|---|
| ***H01R 12/91*** | (2011.01) |
| ***H01R 12/70*** | (2011.01) |
| ***H01R 12/79*** | (2011.01) |
| ***H01R 12/62*** | (2011.01) |

(52) U.S. Cl.

CPC ..... *H01R 12/91* (2013.01); *H01R 12/62* (2013.01); *H01R 12/7064* (2013.01); *H01R 12/79* (2013.01)

(58) Field of Classification Search

CPC ..... H01R 12/62; H01R 12/7064; H01R 12/77–79; H01R 12/91

USPC ..... 439/247–248

See application file for complete search history.

(56) References Cited

U.S. PATENT DOCUMENTS 3,676,746 A * 7/1972 Kassabgi ..... H05K 1/141 361/749
4,934,943 A * 6/1990 Klein ..... H01R 13/631 29/834
4,940,417 A * 7/1990 Hyogo ..... H01R 13/6315 439/248

(Continued)

FOREIGN PATENT DOCUMENTS

TW 200427140 A 12/2004
TW 201545412 A 12/2015

(Continued)

OTHER PUBLICATIONS

Taiwan Patent Office, "Office Action", dated Nov. 7, 2018, Taiwan.

*Primary Examiner* — Oscar C Jimenez
(74) *Attorney, Agent, or Firm* — Locke Lord LLP; Tim TingKang Xia, Esq.

(57) ABSTRACT

A float-type connecting module and a float-type docking device having the module. The float-type docking device includes a float-type connecting module and a pluggable device including at least one dock connector. The float-type connecting module includes a position limiting structure, at least one flexible circuit board and at least one connector. The position limiting structure is provided at the hard circuit board. The connector is for electrically connecting to the dock connector, is electrically connected to the hard circuit board through the flexible circuit board, and floats in the position limiting structure. Thus, the issues of precise alignment required between a slot of a housing and a port of the connector and precise alignment respectively required between connectors and dock connectors are resolved.

12 Claims, 6 Drawing Sheets

(56) References Cited

U.S. PATENT DOCUMENTS 5,344,332 A * 9/1994 Lopez ..... H01R 13/6315 29/854
5,362,243 A * 11/1994 Huss ..... H01R 13/719 361/749
6,146,184 A * 11/2000 Wilson ..... H01R 12/7005 439/248
6,368,116 B1 * 4/2002 Tabata ..... H01R 12/79 439/329
6,422,885 B2 * 7/2002 Kain ..... H01R 12/724 439/247
6,442,027 B2 * 8/2002 Sanada ..... H05K 1/144 29/832
6,595,786 B2 * 7/2003 Horiuchi ..... G06F 1/1616 361/679.17
7,762,825 B2 * 7/2010 Burbank ..... B25J 19/0029 439/247
7,892,001 B2 * 2/2011 Hanyu ..... H01R 23/68 439/247
8,545,247 B2 * 10/2013 Aldana ..... H01R 13/6315 439/248
9,780,497 B1 * 10/2017 Jeon ..... H01R 13/659
2003/0085054 A1 * 5/2003 Ames ..... H01R 12/592 174/254
2007/0082537 A1 * 4/2007 Chien ..... H01R 13/748 439/377
2012/0077386 A1 * 3/2012 Shu ..... H01R 12/62 439/629
2014/0078664 A1 * 3/2014 Lau ..... H01R 12/716 361/679.33
2018/0013244 A1 * 1/2018 Yang ..... H01H 13/52
2018/0269629 A1 * 9/2018 Bernard ..... H01R 13/6315
2018/0375240 A1 * 12/2018 Shing ..... H01R 13/111

FOREIGN PATENT DOCUMENTS

TW 201712964 A 4/2017
TW 201712977 A 4/2017
TW 201814986 A 4/2018
TW M562503 U 6/2018

* cited by examiner

FLOAT-TYPE CONNECTING MODULE AND FLOAT-TYPE DOCKING DEVICE HAVING THE MODULE

BACKGROUND OF THE INVENTION

Field of the Invention

The invention relates to an electrical connection structure, and more particularly to a float-type connecting module and a float-type docking device having the module.

Description of the Prior Art

Docking devices include a connector provided on a circuit board and a pluggable device, wherein the pluggable device includes a dock connector, and a user is only required to align the dock connector with a port of the connector. However, current docking devices suffer from the following issues that need to be overcome.

1. When the connector and the circuit board are both provided in a housing, if a slot provided on the housing is not precisely aligned with the port of the connector, even if the connector and the dock connector are only one in quantity, it is impossible or difficult for the dock connector of the pluggable device to be docked to the port of the connector through the slot on the housing.

2. In response to the issue that a transmission speed of docking devices cannot be effectively increased, the inventor of the application plans to simultaneously configure a plurality of (two or more) dock connectors on a pluggable device in order to increase the transmission speed, and to correspondingly simultaneously configure a plurality of (two or more) connectors on a circuit board. Thus, although the object of increasing the transmission speed is achieved, another issue of precise alignment respectively required between the connectors and the dock connectors is resulted.

Therefore, it is a task of the inventor of the present invention to provide an invention in which a connector is allowed to correspondingly float along with plugging of a dock connector.

SUMMARY OF THE INVENTION

It is an object of the present invention to provide a float-type connecting module and a float-type docking device having the module, which allow a connector to correspondingly float along with the plugging of a dock connector, thus simultaneously resolving the issues of precise alignment required between a slot on a housing and a port of the connector and precise alignment respectively required between connectors and dock connectors.

To achieve the above object, the present invention provides a float-type connecting module, including: a position limiting structure, provided at a hard circuit board; at least one flexible circuit board; and at least one connector, electrically connected to the hard circuit board through the at least one flexible circuit board, and floating in the position limiting structure.

The present invention further provides a float-type dock connecting device, including: a pluggable device, including at least one dock connector; and a float-type connecting module. The float-type connecting module includes: a position limiting structure, provided at a hard circuit board; at least one flexible circuit board; and at least one connector, for electrically docking to the at least one dock connector, electrically connected to the hard circuit board through the at least one flexible circuit board, and floating in the position limiting structure.

Compared to the prior art, the present invention achieves following effects. Given that one dock connector is correspondingly plugged with a port of at least one connector, the at least one connector is allowed to correspondingly float in the position limiting structure along with the plugging of the at least one dock connector, thus guiding and aligning the at least one connector to be precisely docked with the at least one dock connector, thereby simultaneously resolving the issues of precise alignment required between a slot on a housing and the port of the connector and precise alignment respectively required between connectors and dock connectors.

DETAILED DESCRIPTION OF THE EMBODIMENTS

Figure 1:
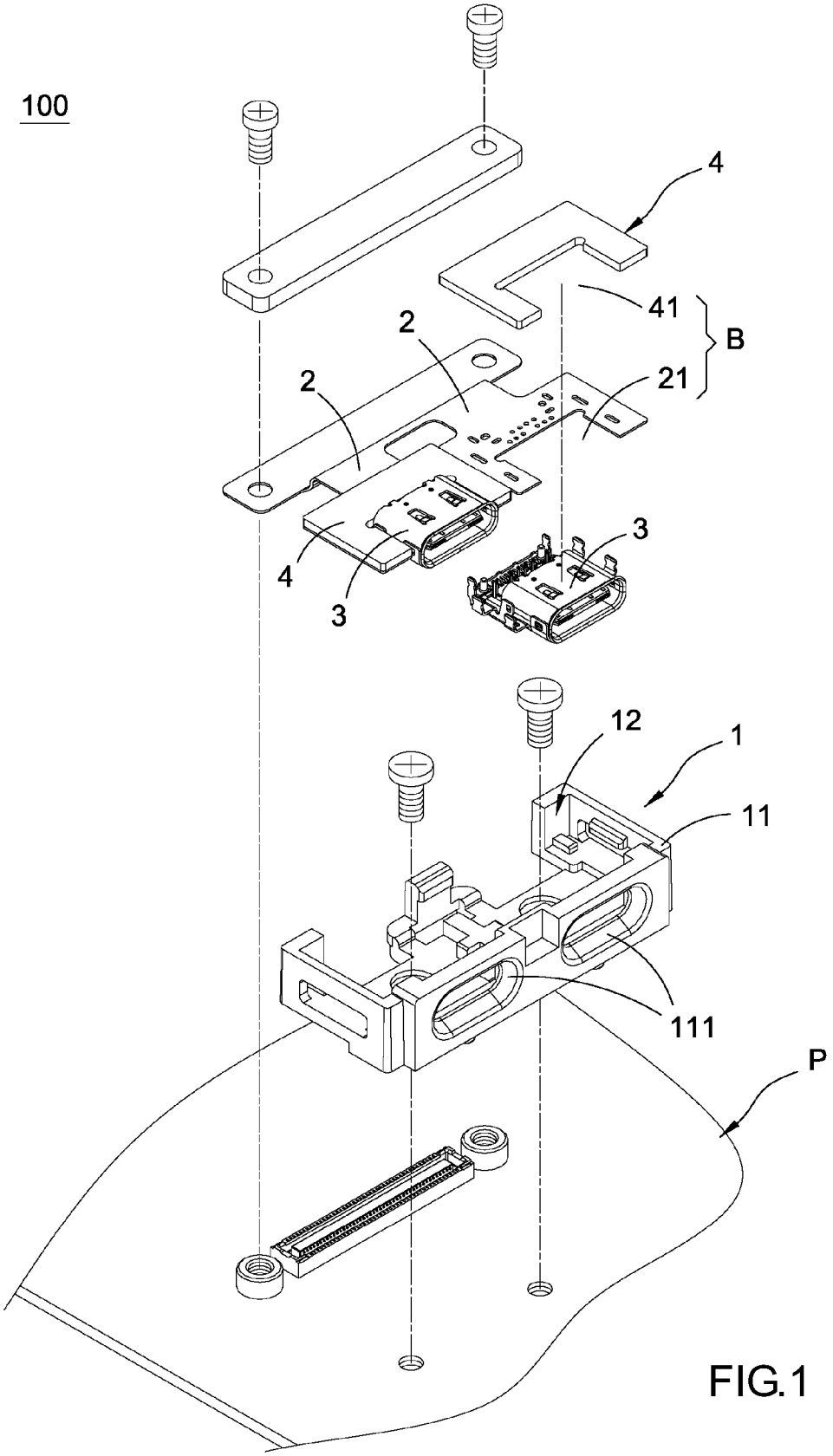
FIG. 1 is an exploded perspective view of a float-type connector module of the present invention.

Details and technical contents of the present invention are given with the accompanying drawings below. It should be noted that these drawings are for reference and illustration purposes, and are not to be construed as limitations to the present invention.

Referring to FIG. 1 to FIG. 5, the present invention provides a float-type connecting module and a float-type docking device having the module. The float-type docking device of the present invention includes a float-type connecting module 100 and a pluggable device 800. The pluggable device 800 may be various types of devices capable of correspondingly pluggably connected to a connector 3, and is not specifically limited by the present invention. In this embodiment, a pluggable storage device having at least one dock connector 8 is given as an example for illustration. The float-type connecting module 100 includes a position limiting structure 1, at least one flexible circuit board 2 and at least one connector 3, and preferably includes at least one stiffening element 4, which are to be described in detail below.

The position limiting structure 1 is provided at a hard circuit board P, in a way that the connector 3 is limited to float in the position limiting structure 1. The hard circuit board P may be a main circuit board provided in an electronic product (not shown), or may be an independent miniature circuit board or a sub circuit board electrically connected to a main circuit board; the present invention is not limited to the above examples.

The present invention does not limit the position limiting structure 1 to a specific structure, and any structure providing a sliding groove 12 for the connector 3 or the stiffening element 4 to float therein can be used. In other words, the position limiting structure 1 may include a sliding groove 12 formed from any structure, and preferably further includes a frame 11 that is provided on the hard circuit board P. A space encircled by the frame 11 forms the sliding groove 12.

The connector 3 is electrically connected to the hard circuit board P through the flexible circuit board 2. More specifically, the connector 3 and the hard circuit board P are electrically connected to two ends of the flexible circuit board 2, respectively, so as to shift the connector 3 when a force is applied thereon through the flexibility of the flexible circuit board 2 to further allow the connector 3 to float in the position limiting structure 1.

Figure 2:
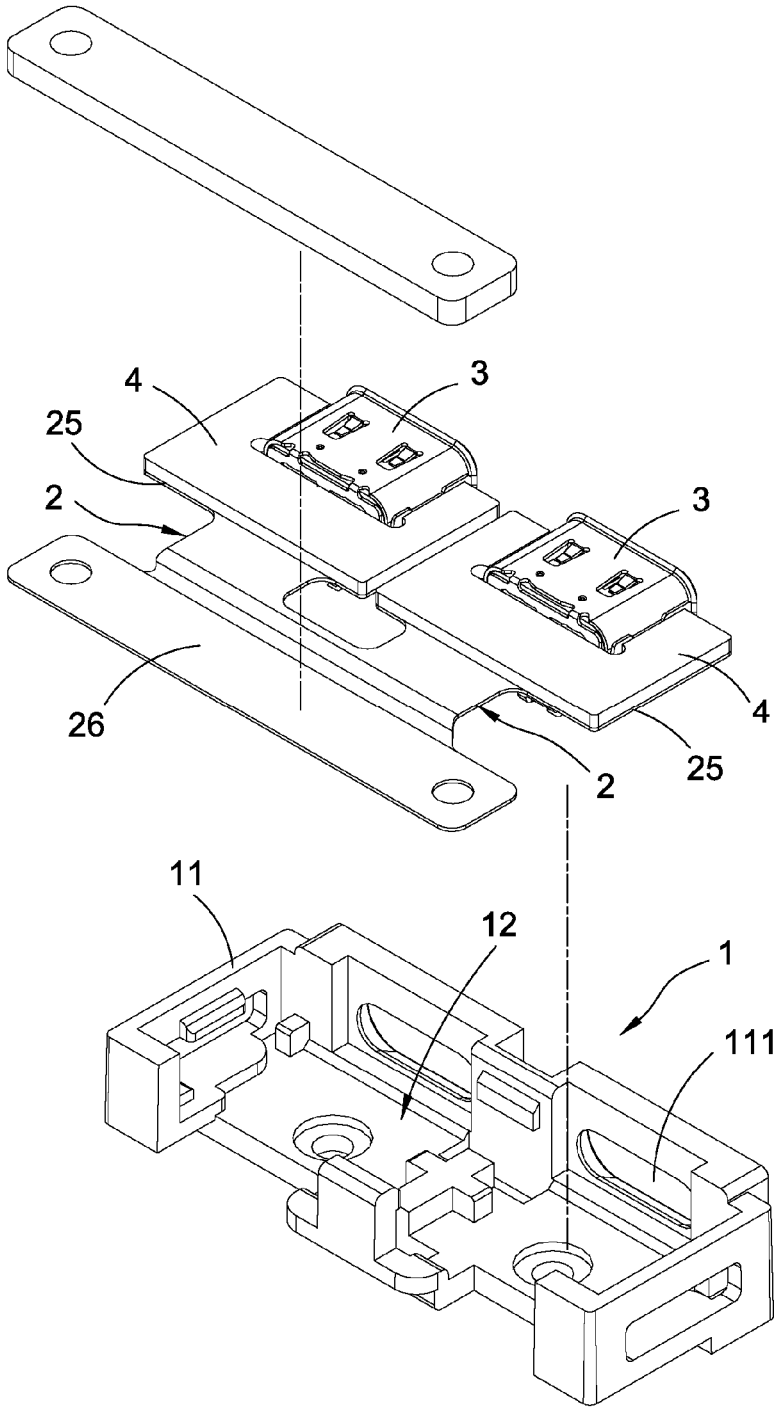
FIG. 2 is an exploded perspective view of some components in FIG. 1 from another viewing angle.
Figure 3:
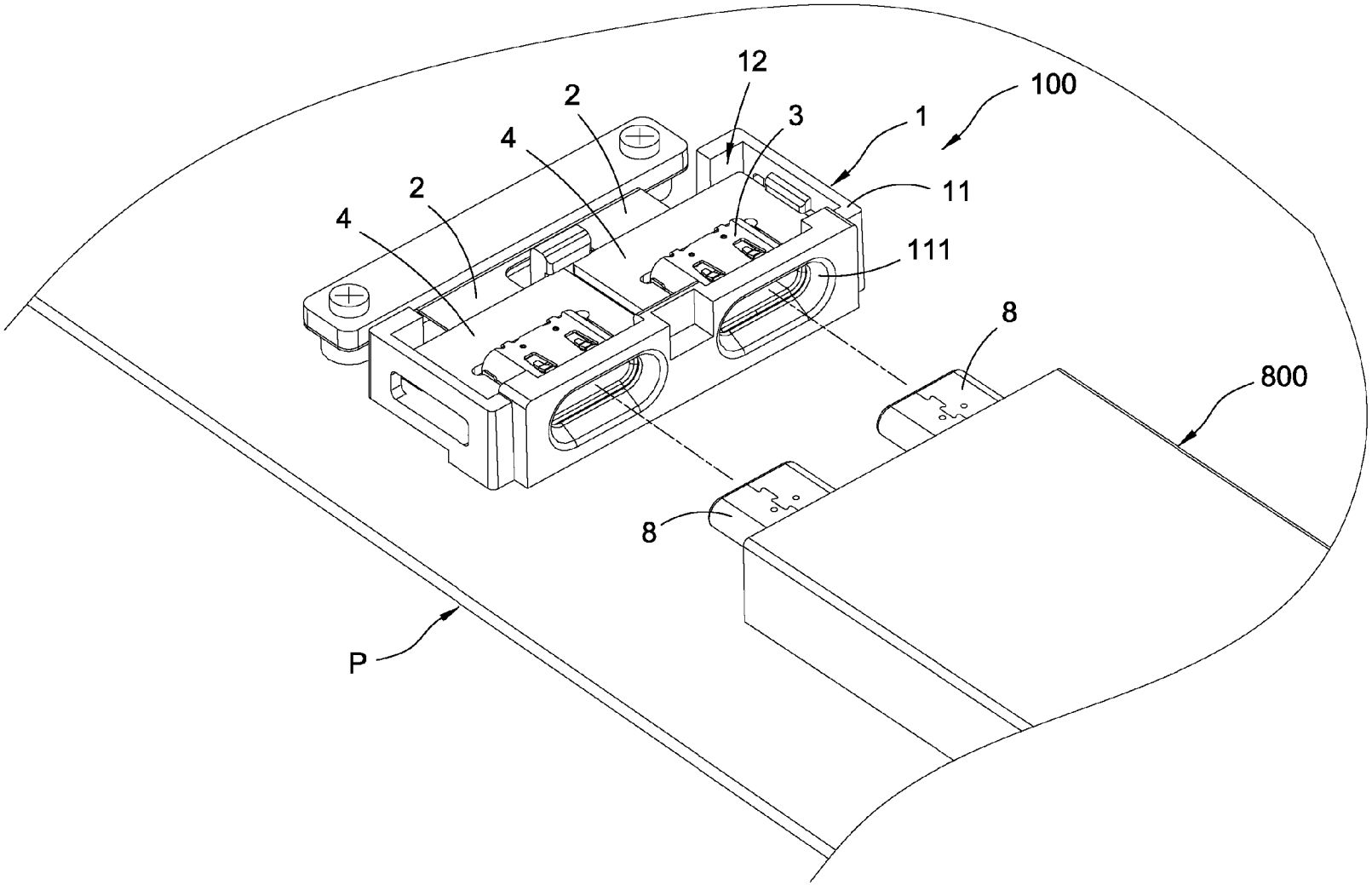
FIG. 3 is a perspective view of a float-type docking device of the present invention before docking.

Clearance fit is adopted between the stiffening element 4 and the frame 11 of the position limiting structure 1; that is, a margin for both horizontal and vertical floating movements is preserved between the stiffening element 4 and the frame 11, such that the connector 3 is allowed to float in the position limiting structure 1 through the stiffening element 4. The stiffening element 4 is an object having an opposite property to the flexibility of the flexible circuit board 2, e.g., a hard board (as shown in FIG. 2) which may be correspondingly provided at three peripheral sides of the connector 3, or may be a hard flange (not shown) protruding from three peripheral sides of the connector 3. The present invention does not limit the structure of the stiffening element 4, given that the stiffening element 4 is not flexible and is capable of floating in the position limiting structure 1.

The quantities of the flexible circuit board 2, the connector 3, the stiffening element 4 and the dock connector 8 may be one or plural (two or more), and is not limited by the present invention.

In other embodiments that are not depicted by the drawings, the quantities of the flexible circuit board 2, the connector 3, the stiffening element 4 and the dock connector 8 are one, with associated details given below.

As shown in FIG. 3 to FIG. 6, at this point, to plug the dock connector 8 of the pluggable device 800 to the connector 3, even if the port of the connector 3 is not precisely aligned with a slot (not shown) on a housing of the electronic device, the connector 3 is allowed to correspondingly float in the position limiting structure 1 along with the plugging of the dock connector 8 given that the dock connector 8 is correspondingly plugged with the port of the connector 3, thereby guiding and aligning the connector 3 to be precisely docked with the dock connector 8. In other words, the present invention resolves the issue of precise alignment originally required between a slot on a housing and the port of the connector 3.

In the embodiment shown in the drawings, the quantities of the flexible circuit board 2, the connector 3, the stiffening element 4 and the dock connector 8 are two as an example, with associated details given below.

The flexible circuit boards 2 are electrically connected between the connectors 3 and the hard circuit board P, respectively, allowing the connectors 3 to respectively float in the position limiting structure 1 through the stiffening elements 4, respectively. Thus, two stiffening elements 4 are arranged side by side and are slidably connected in the sliding groove 12 to generate a side-by-side direction D1 (referring to FIG. 5, i.e., a lateral direction), such that the two stiffening elements 4 can slidably move along both the side-by-side direction D1 and an up-and-down direction D2 (referring to FIG. 4, i.e., a longitudinal direction) substantially perpendicular to the side-by-side direction D1.

Figure 4:
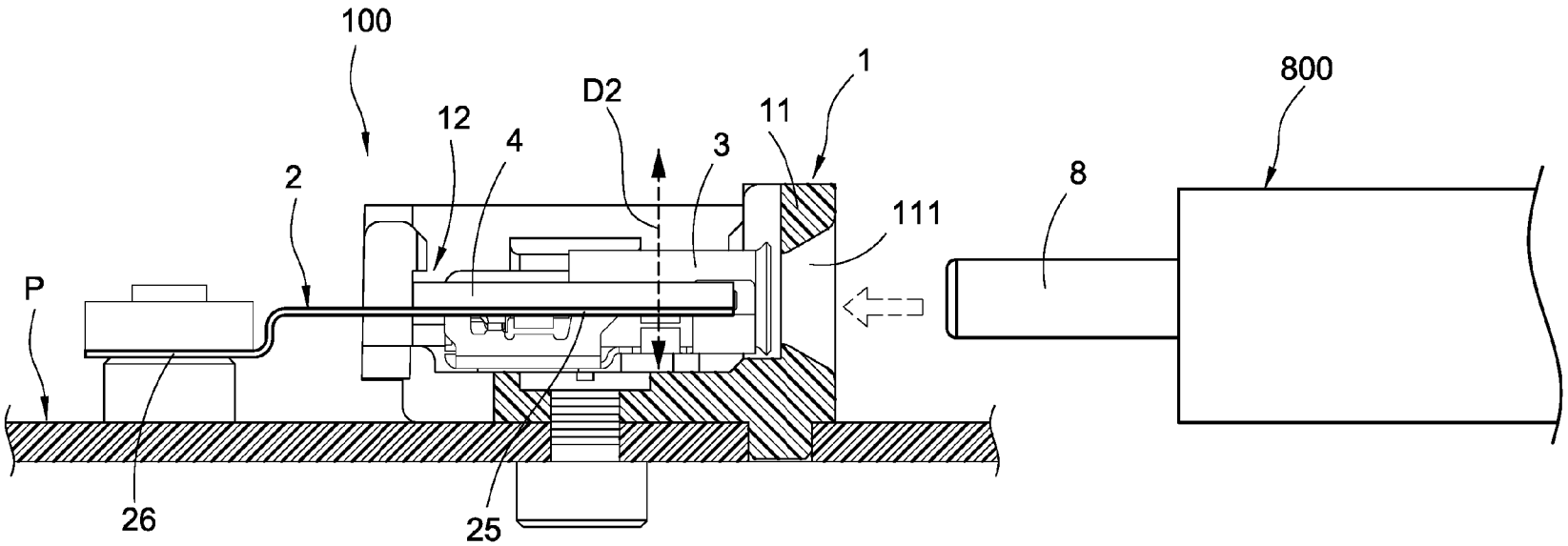
FIG. 4 is a partial section view of a float-type docking device of the present invention before docking.
Figure 5:
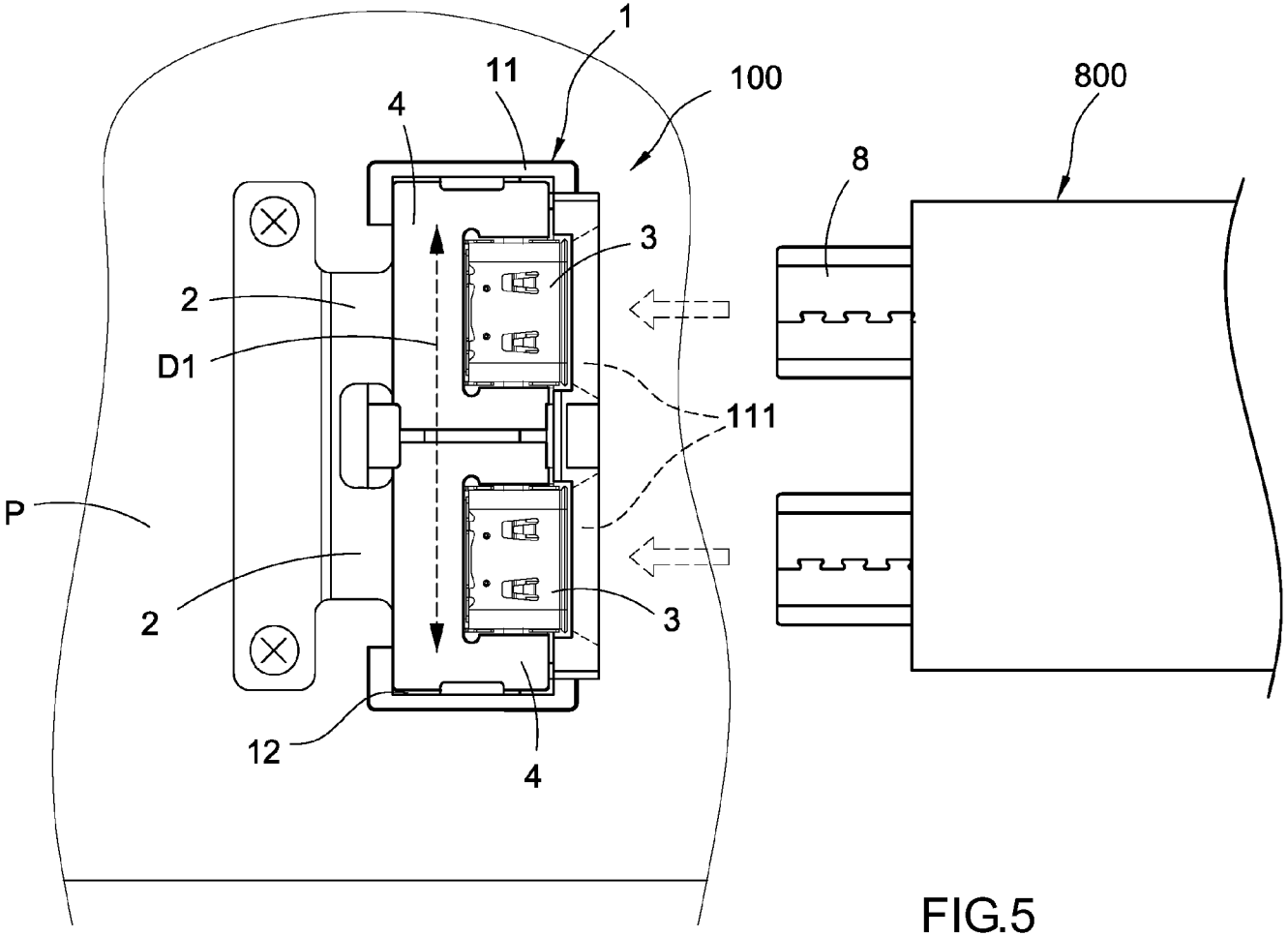
FIG. 5 is a top view of a float-type docking device of the present invention before docking.
Figure 6:
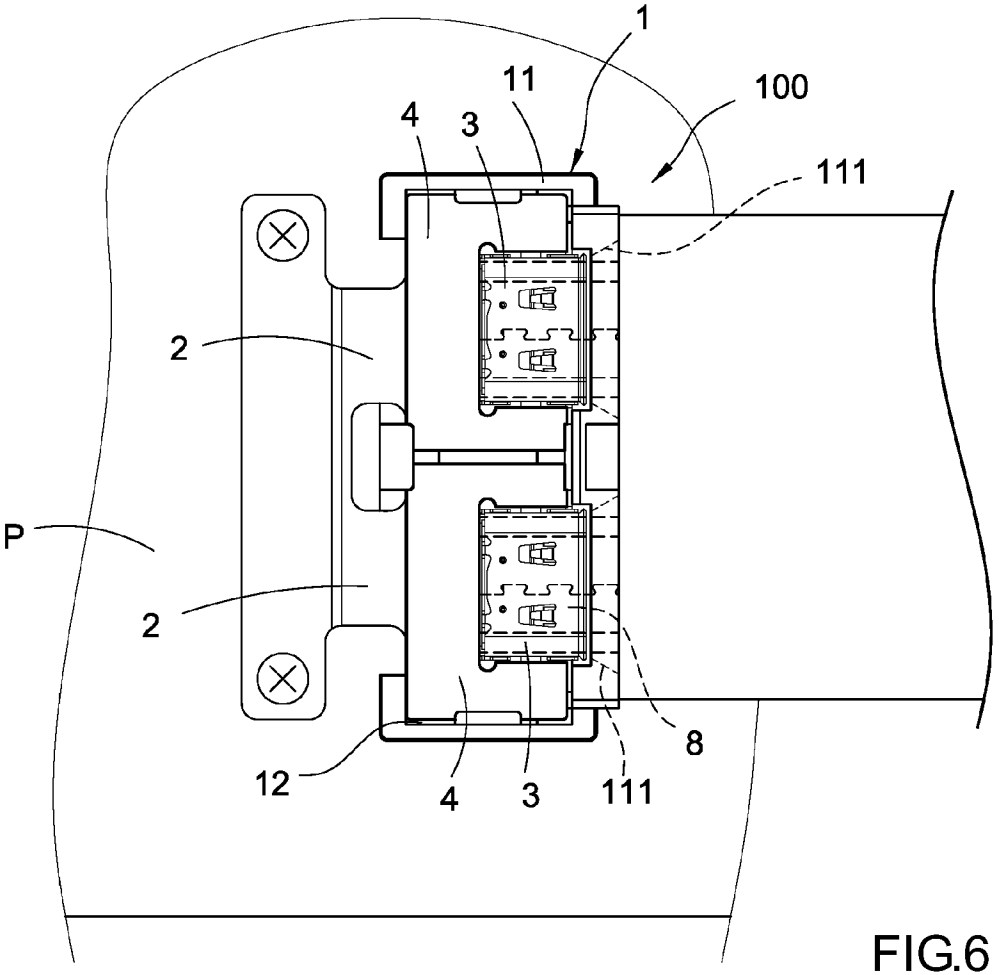
FIG. 6 is a top view of a float-type docking device of the present invention after docking.

More specifically, as shown in FIG. 4, one end 25 of each flexible circuit board 2 is overlappingly adhered and fixed to each stiffening element 4 and is electrically connected to each connector 3. Preferably, as shown in FIG. 1 and FIG. 2, a first notch 21 is provided at one end 25 of each flexible circuit board 2, a second notch 41 is provided at each stiffening element 4, and each first notch 21 and each second notch 41 are mutually corresponding and jointly form a notch portion B, in which each connector 3 is accommodated, in a way that the stiffening element 4 and one end 25 of the flexible circuit board 2 semi-encircle around the connector 3. The other end 26 of each flexible circuit board 2 is electrically connected to the hard circuit board P.

The connector 3 may be simultaneously electrically connected to the stiffening element 4 and the one end 25 of the flexible circuit board 2 such that the three are mutually fixed, as shown in the drawings. Alternatively, the connector 3 may be first electrically connected to the one end 25 of the flexible circuit board 2, and then the stiffening element 4 is adhered and fixed to the same end 25 (not shown) of the flexible circuit board 2; further, the stiffening element 4 and the flexible circuit board 2 are not electrically connected.

As shown in FIG. 3 to FIG. 6, thus, to plug two dock connectors 8 of the pluggable device 800 to two connectors 3 on the hard circuit board 9, even if the ports of the two connectors 3 are not respectively precisely aligned with the two dock connectors 8, given that the two dock connectors 8 are correspondingly plugged with the ports of the two connectors 3, respectively, the two connectors 3 are allowed to correspondingly float in the position limiting structure 1 along with the plugging of the two dock connectors 8, respectively, thereby guiding and aligning the two connectors 3 to be precisely docked with the two dock connectors 8, respectively. In other words, the present invention is capable of specifically resolving the issue of precise alignment originally respectively required between the connectors 3 and the dock connectors 8.

Preferably, the frame 11 may be provided with, at a position corresponding to the port of each connector 3, a guiding hole 111, which is in a bell-mouth shape having an outer large aperture that gradually narrows from the exterior towards the interior to an inner small aperture, accordingly allowing each dock connector 8 to be smoothly guided to the port of each corresponding connector 3.

Further, the foregoing connector 3 may be any electrical connector, and the present invention does not limit the type of the connector 3. In this embodiment, a USB Type-C socket connector is given as an example, and the dock connector 8 is then a USB Type-C plug connector, so as to have a better transmission speed on the basis of the USB Type-C interface used. Vice versa, the connector 3 may be a USB Type-C plug connector, and the dock connector 8 may be a USB Type-C socket connector. Further, the flexible circuit boards 2 may be independent units (not shown), or may have the one end 25 separated from another while the other end 26 integrally connected to another; the present invention does not limited the flexible circuit board 2 to be in a specific form.

In other embodiments not depicted in the drawings, the quantities of the connector 3, the stiffening element 4 and the dock connector 8 may still be two, and only the quantity of the flexible circuit board 2 is modified to be one. In the above situation, even if only one flexible circuit board 2 is adhered and fixed with two connectors 2, due to the flexibility of the flexible circuit board 2, the pre-flexed flexible circuit board 2 may be placed in the sliding groove 12, such that the two connectors 3 are allowed to float close to each other (the flexible circuit board 2 is to be bent to a greater extent), and also float away from each other (the pre-flexed part of the flexible circuit board 2 is to be relatively stretched). Further, the two connectors 3 may be a first plug connector and a first socket connector, respectively, and the two dock connectors 8 may be a second socket connector and a second plug connector respectively corresponding to the connectors 3.

In conclusion, the float-type connecting module and the float-type docking device having the module of the present invention achieve the expected application objects and thus resolve the issues of the prior art, and are novel and involve an inventive step that comply to the criteria for a patent application. Therefore, a patent application is filed accordingly, and the granting to patent rights after thorough examination is respectively requested so as to protect rights of the inventor.

What is claimed is:

1. A float-type connecting module, comprising:

a position limiting structure, provided at and fixed onto a hard circuit board;

at least one flexible circuit board; and at least one connector, electrically connected to the hard circuit board through the at least one flexible circuit board, being floating in the position limiting structure, wherein the at least one connector has three degrees of freedom in the position limiting structure;

wherein the connectors are plural in quantity, and the at least one flexible circuit board is electrically connected between the plurality of connectors and the hard circuit board;

wherein the position limiting structure comprises a sliding groove, and the plurality of connectors slidably move in the sliding groove along both a side-by-side direction and an up-and-down direction substantially perpendicular to the side-by-side direction.

2. The float-type connecting module according to claim 1, wherein the connector is provided as plural in quantity, and the plurality of connectors are electrically connected to the hard circuit board through the at least one flexible circuit board and respectively float in the position limiting structure.

3. The float-type connecting module according to claim 1, further comprising at least one stiffening element, and the connector floats in the position limiting structure through the stiffening element.

4. The float-type connecting module according to claim 3, wherein the connector, the flexible circuit board and the stiffening element are plural in quantity, the flexible circuit boards are electrically connected between the connectors and the hard circuit board, respectively, and the connectors float in the position limiting structure through the stiffening elements, respectively.

5. The float-type connecting module according to claim 4, wherein the position limiting structure comprises a frame and a sliding groove formed in the frame, the frame is provided at the hard circuit board, and the plurality of stiffening element slidably move in the sliding groove both along the side-by-side direction and an up-and-down direction substantially perpendicular to the side-by-side direction.

6. The float-type connecting module according to claim 5, wherein the frame is provided with, at a position corresponding to a port of the connector, a guiding hole, and each guiding hole has an outer large aperture that gradually narrows from an exterior towards an interior to an inner small aperture and is used for guiding.

7. The float-type connecting module according to claim 4, wherein one end of each flexible circuit board is attached to each stiffening element and is electrically connected to each connector, and one other end of each flexible circuit board is electrically connected to the hard circuit board.

8. The float-type connecting module according to claim 7, wherein each stiffening element and the one end of each flexible circuit board mutually overlap and jointly semi-encircle around each connector.

9. The float-type connecting module according to claim 7, wherein one end of each flexible circuit board is provided with a first notch, each stiffening element is provided with a second notch, each first notch and each second notch mutually correspond and jointly form a notch portion, and each connector is accommodated in each notch portion.

10. A float-type docking device, comprising:

a pluggable device, comprising at least one dock connector; and a float-type connecting module, comprising:

a position limiting structure, provided at and fixed onto a hard circuit board;

at least one flexible circuit board; and at least one connector, for electrically docking the at least one dock connector, the at least one connector electrically connected to the hard circuit board through the at least one flexible circuit board and being floating in the position limiting structure, wherein the at least one connector has three degrees of freedom in the position limiting structure;

wherein the connectors are plural in quantity, and the at least one flexible circuit board is electrically connected between the plurality of connectors and the hard circuit board;

wherein the position limiting structure comprises a sliding groove, and the plurality of connectors slidably move in the sliding groove along both a side-by-side direction and an up-and-down direction substantially perpendicular to the side-by-side direction.

11. The float-type docking device according to claim 10, wherein the connector, the flexible circuit board and the dock connector are provided as plural in quantity, each connector is for electrically docking each dock connector, each connector is electrically connected to the hard circuit board through each flexible circuit board, and the plurality of connectors respectively float in the position limiting structure.

12. A float-type connecting module, comprising:

a position limiting structure, provided at a hard circuit board;

at least one flexible circuit board;

at least one connector, electrically connected to the hard circuit board through the at least one flexible circuit board, being floating in the position limiting structure; and at least one stiffening element, the connector floating in the position limiting structure through the stiffening element;

wherein the connector, the flexible circuit board and the stiffening element are plural in quantity, the flexible circuit boards are electrically connected between the connectors and the hard circuit board, respectively, and the connectors float in the position limiting structure through the stiffening elements, respectively;

wherein one end of each flexible circuit board is attached to each stiffening element and is electrically connected to each connector, and one other end of each flexible circuit board is electrically connected to the hard circuit board;

wherein one end of each flexible circuit board is provided with a first notch, each stiffening element is provided with a second notch, each first notch and each second notch mutually correspond and jointly form a notch portion, and each connector is accommodated in each notch portion.

* * * * *